United States Patent [19]

Mackintosh

[11] 4,162,594

[45] Jul. 31, 1979

[54] MOVABLE SEATING METHOD

[76] Inventor: Charles Mackintosh, 3838 Oakwood Ave., Los Angeles, Calif. 90004

[21] Appl. No.: 897,546

[22] Filed: Apr. 18, 1978

[51] Int. Cl.[2] ..... E04H 3/12

[52] U.S. Cl. ..... 52/9; 52/143

[58] Field of Search ..... 52/6–10, 52/183, 111, 116, 143, 79.5, 122, 741, 745; 296/64

[56] References Cited

U.S. PATENT DOCUMENTS

| | | | |
|---|---|---|---|
| 1,433,547 | 10/1922 | Hadden | 52/9 |
| 2,663,914 | 12/1953 | Mackintosh | 52/9 |
| 3,002,234 | 10/1961 | Waterbury | 52/9 |
| 3,685,220 | 8/1972 | Morrison | 52/8 |
| 3,885,827 | 5/1975 | Sanders | 296/64 |
| 3,914,909 | 10/1975 | McNeal | 52/9 |
| 4,026,076 | 5/1977 | Analetto | 52/6 |
| 4,102,086 | 7/1978 | Korman | 52/9 |

*Primary Examiner*—J. Karl Bell

*Attorney, Agent, or Firm*—Watson, Cole, Grindle & Watson

[57] ABSTRACT

A plurality of portable grandstand seating sections forming a grandstand are each provided with central ground-engaging wheels and footings, either of which being retractable and extendable for supporting each section alternately with the wheels and the central footings. A collapsible and extendable rear footing is also provided on each section. The sections are capable of being transported between grandstand and storage locations by towing them on the wheels with the rear footings collapsed. A first of such sections which forms an end section of the grandstand is lifted at the grandstand location and is shifted away from an adjoining section, the wheels are placed in a ground-engaging position, the rear footing is collapsed, the rearward end of the section is lowered relative to the wheels and the section is towed on the wheels while supporting the rearward end. The second and remaining sections are thereafter transported in succession to the storage location. When transporting the sections to the grandstand location, a section is rolled on the wheels while supporting its rearward end with the rear footing collapsed. The rearward end is raised at the grandstand location, the wheels are retracted or the central footing is extended and the rear footing is extended for supporting the section on both footings. It is then shifted into a predetermined position for commencing formation of the grandstand, and the remaining grandstand sections are transported in succession to the grandstand location with each being shifted in succession into abutting engagement with a side end of a previously transported section.

28 Claims, 8 Drawing Figures

MOVABLE SEATING METHOD

BACKGROUND OF THE INVENTION

This invention relates generally to a method of setting up and taking down a grandstand formed of a plurality of portable grandstand seating sections, and more particularly to such a method wherein each section may be quickly and effectively towed between storage and grandstand locations and shifted into place at the latter.

Seating sections for the forming of a grandstand, such as designed to accommodate seating for indoor and outdoor sports and entertainment events and facilities, have in the past been made portable to some extent to facilitate the setting up and the taking down of the grandstand. Wheels have been provided on such sections to facilitate arranging them in place at a motion picture studio, for example. However, the wheels are generally of the caster type allowing them to swivel while manipulating the sections into place. Also, grandstand sections have in the past been made into sub-sections to facilitate grandstand set up and take down operations, and grandstand sections have previously been transported between storage and grandstand locations on air dolleys, water dolleys, rails and by means of fork lifts.

The problem with all these prior approaches used in the setting up and taking down of a grandstand, is that the grandstand sections or sub-sections are so unwieldy and bulky that the time involved in properly setting them up and returning them to storage is quite significant from a cost standpoint. Because of the elevated rearward ends of typical grandstand sections, they cannot clear confined passageways and they cannot be readily piled on top of one another in storage, so that extra space which usually comes at a high premium at both indoor and outdoor stadium sites, must be found. And, those grandstand sections provided with caster wheels are extremely difficult to maneuver around on especially a soft outdoor surface, since the sections are typically wheeled from storage to the grandstand location by a fork lift track or the like and are roughly set into a predetermined position whereafter the sections must be side shifted into place. It can be appreciated that, during such side shifting of grandstand sections which are typically of massive size and weight, the casters only dig themselves into the soft ground as they are swivelled so that oftentimes gaps are left between adjacent grandstand sections thereby requiring fillers to be installed which is time-consuming and therefore costly. And, even on a hard indoor surface, it becomes difficult to side shift the sections precisely in place without the expenditure of undue effort and time. The use of rails and dolleys for transporting the sections between the storage and grandstand locations are likewise impractical since the heavy sections are difficult to side shift unless undue time and effort is expended and, even then, gaps are left between adjacent sections which must be filled thereby further increasing the time and expense of the operation.

OBJECTS OF THE INVENTION

It is therefore an object of this invention to provide a technique for setting up and taking down a grandstand, formed of a plurality of portable grandstand sections, in a manner which is more efficient, more economical, time and space saving and highly effective as compared to techniques applied in the past.

Another object of this invention is to provide such a method wherein each grandstand section has an extendable and retractable wheel means or an extendable and retractable central footing together with a collapsible rear footing to facilitate wheeling the sections into and from a storage location while the rearward end thereof is lowered thereby permitting each section to more easily pass through confined areas, to be more easily stored and to be more quickly set up to form a grandstand.

A further object of this invention is to provide such a method wherein the wheel means or the central footing is extendable and retractable relative to each other for alternately engaging the ground so that the central footing supports the section when set up and the wheels form rolling supports for the sections when being moved. The rear footings are collapsed when they are in transport and in storage but are extended into an erect position at the grandstand location.

A still further object of the present invention is to provide such a method wherein the approach in transporting each section to its storage location includes a lifting of a first of such sections which forms an end section of the grandstand and a shifting of such section away from an adjacent abutting section. The wheels are placed in a ground-engaging position, the rear footing is retracted inwardly, the rearward end of the section is lowered relative to the wheels and the section is rolled on the wheels while supporting the rearward end. The remaining sections of the grandstand are similarly transported to storage.

A still further object of this invention is to provide such a method which includes the transporting of the grandstand sections from storage to the grandstand location by rolling one of the sections on its wheels while supporting its rearward end with the rear footing retracted, raising the rearward end at the grandstand location, retracting the wheels or extending the central footing and extending the rear footing for supporting the section thereon, and shifting the section into a predetermined position for commencing formation of the grandstand. These steps are repeated for the remainder of the sections which are shifted in succession into abutting engagement with a side end of a previously transported section.

A still further object of the present invention is to provide such a method wherein the rear footing is hinged to the grandstand section and is provided with rollers at one end so that, during the lowering of the rearward end when taking down the grandstand, the rear footing may be automatically collapsed upon movement thereof along the rollers.

Other objects, advantages and novel features of the invention will become more apparent from the following detailed description of the invention when taken in conjunction with the accompanying drawings.

DETAILED DESCRIPTION OF THE INVENTION

Figure 1:
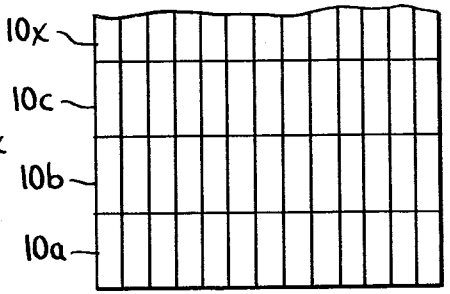
FIG. 1 is a schematic plan view, in reduced scale, showing a portion of a grandstand assembled of portable grandstand sections.
Figure 2:
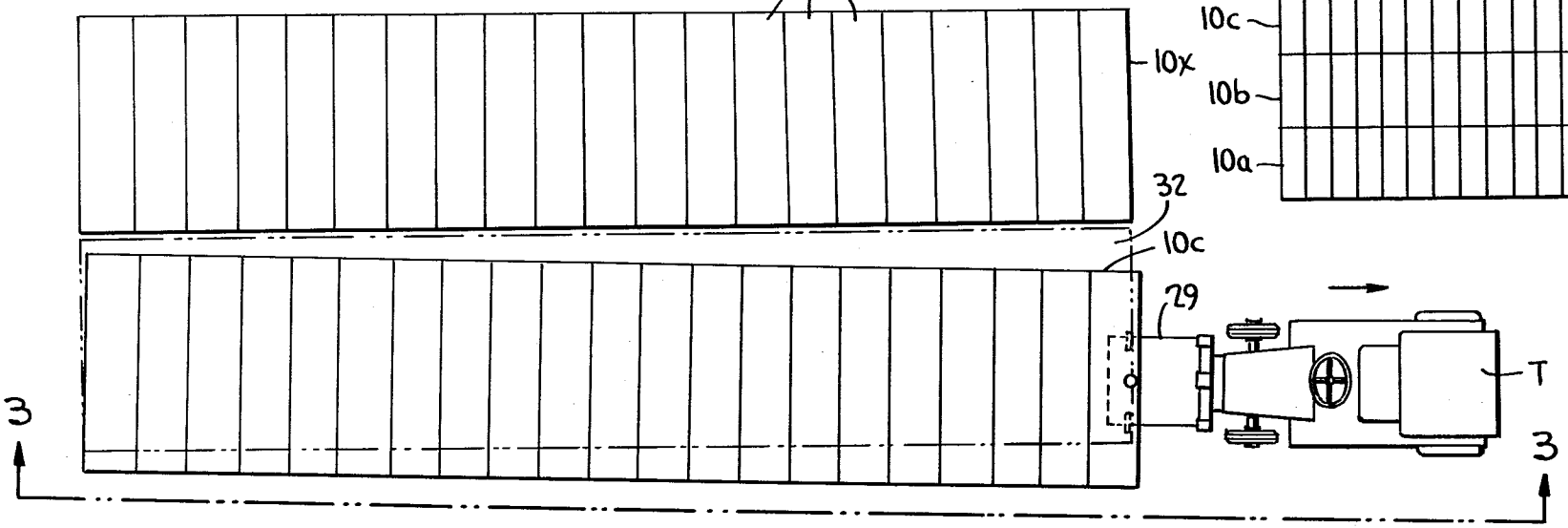
FIG. 2 is a view similar to FIG. 1, but at an enlarged scale, showing the manner of taking down a grandstand section from the grandstand.
Figure 3:
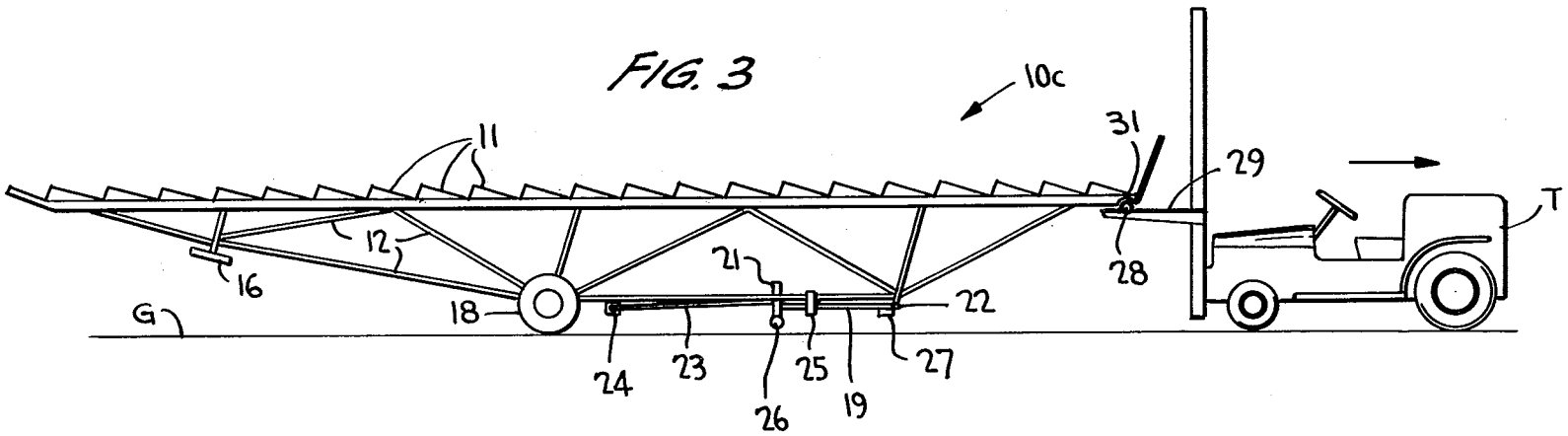
FIG. 3 is a side elevational view taken along line 3—3 of FIG. 2 of a grandstand section in the process of taking it down according to the invention.
Figure 6:
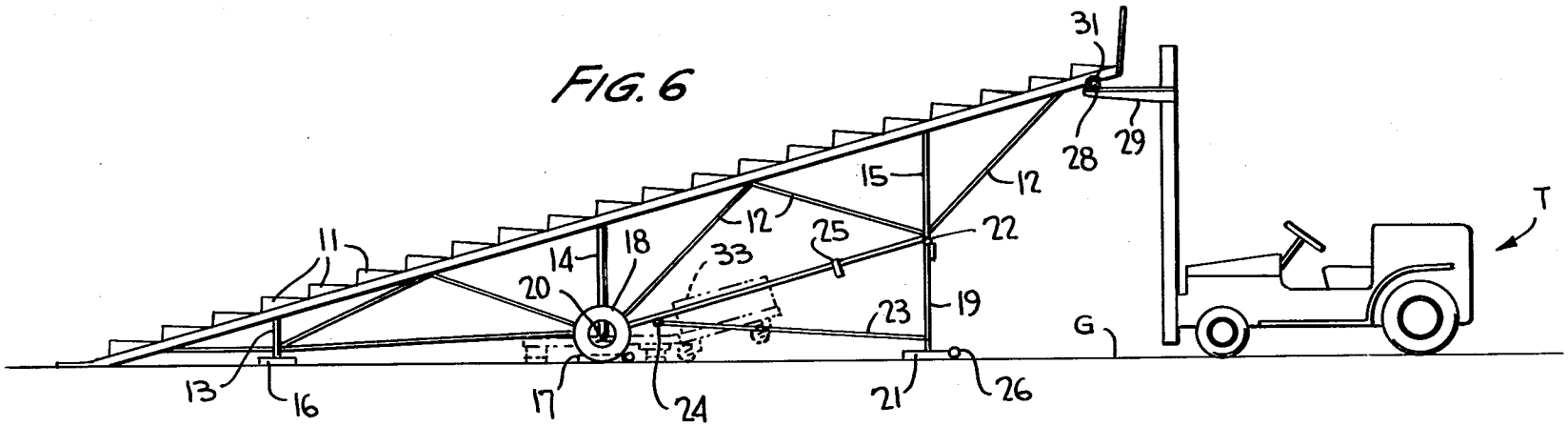
FIG. 6 is a side elevational view of an erect grandstand section showing the side shifting apparatus in phantom outline.

Turning now to the drawings wherein like reference characters refer to like and corresponding parts throughout the several views, a portion of an assembled grandstand is generally shown in FIG. 1 as comprising a plurality of grandstand sections 10*a*, 10*b*, 10*c*, 10*x*, etc. each of which are substantially rectangular and may include angular sections to facilitate L-shaped and U-shaped grandstands for both indoor and outdoor seating. Each grandstand section 10 is portable and is capable of being transported from a suitable storage location (not shown) to the grandstand location of FIG. 1 which is placed in an erect position, is side shifted against a previously positioned section, and is tied down to that section if required. As shown in FIGS. 2, 3 and 6, each section includes a plurality of seats 11 and a network of braces 12 which, as in any normal manner, provide the structural integrity of each section. Vertical structural supports 13, 14 and 15 are provided on each section, and a ground-engaging footing 16, extending substantially along the width of the section, is mounted at the lower end of forward supports 13. A similar type footing 17 is mounted at the lower end of central supports 14. A pair of axle-mounted wheels 18 are mounted to supports 14 at the outer sides thereof for engaging the ground when extended by actuators such as hydraulic, pneumatic, screw or the like, generally designated 20. Alternatively, central footing 17 may be made extendable and retractable by a similar type actuator 20. And, a rearward footing assembly including vertical legs 19 and a footing 21 mounted at the end thereof is hinged as at 22 to the understructure of the section for pivotal movement between a collapsed position of FIG. 3 and an erect position of FIG. 6. Braces 23 are hinged to the understructure as at 24 at one end and engage legs 19 at an opposite end thereof for bracing the legs when in their erect position of FIG. 6. Braces 23 may be latched as at 25 to the understructure of the section when legs 19 are in their collapsed position of FIG. 3. And, idler rollers 26 are provided on the rearward end of footing 21 for a purpose to be more fully described hereinafter.

While in storage each section lies in a substantial horizontal position of FIG. 3 except that footing 17 is placed in a ground-engaging position to serve as a support, on the floor or ground G, together with an auxiliary footing 27 provided at the knee joint between legs 19 and the understructure. In setting up the grandstand, one of the sections 10*x* is transported from storage to the grandstand location and is set up there. The method of transporting and setting up will be described with reference to grandstand section 10*c* for purposes of illustrating the side shift technique. A fork lift truck T of the standard variety is utilized for transporting this section. The truck is provided with a bearing member 28 on its fork member 29, the bearing engaging a downwardly open cup 31 or the like provided in the grandstand section adjacent the rearward end thereof. (Alternatively, bearing 28 and cup 31 may be respectively provided on the grandstand and on fork member 29.) The bearing therefore effectively functions as a "fifth wheel" of the truck similarly as in a tractor-trailer vehicle. Wheels 18 are placed in a ground-engaging position, as by extending the wheels or retracting central footing 17, and fork 29 of the truck is elevated sufficiently to raise auxiliary footing 27 slightly off the ground as shown in FIG. 3. Section 10*c* is then towed by the truck in the direction of the arrow of FIG. 3, from storage to the grandstand location. Section 10*c* is roughly positioned at the grandstand location so as to be placed as closely as possible to a previously located section 10*x*, as shown in FIG. 2. Typically, because of the long length of the grandstand section and its heavy weight, and because of its being rolled on a single set of wheels 18, the fork lift truck operator will typically be able to only maneuver the grandstand section so as to leave a small gap 32, at best, between sections 10*c* and 10*x*. At this position legs 19 are unlatched thereby allowing rollers 26 of footing 21 to bear on the ground, and the rearward end of section 10*c* is elevated by the raising of fork 29. While the rearward end of the section is being elevated, legs 19 automatically pivot under the force of gravity about hinge 22 into a vertical position as it moves on rollers 26. Braces 23 are then unlatched and are pivotally moved into engagement with legs 19, and may be locked in place in any normal manner. Wheels 18 are then retracted, or footing 17 is extended, until footing 17 engages the ground. The grandstand section is then in its fully erect position of FIG. 6, whereafter fork 29 of the truck may be lowered and the truck returned back to the storage location for repeating the aforedescribed operation for the next grandstand section 10*b* to be set up.

Figure 4:
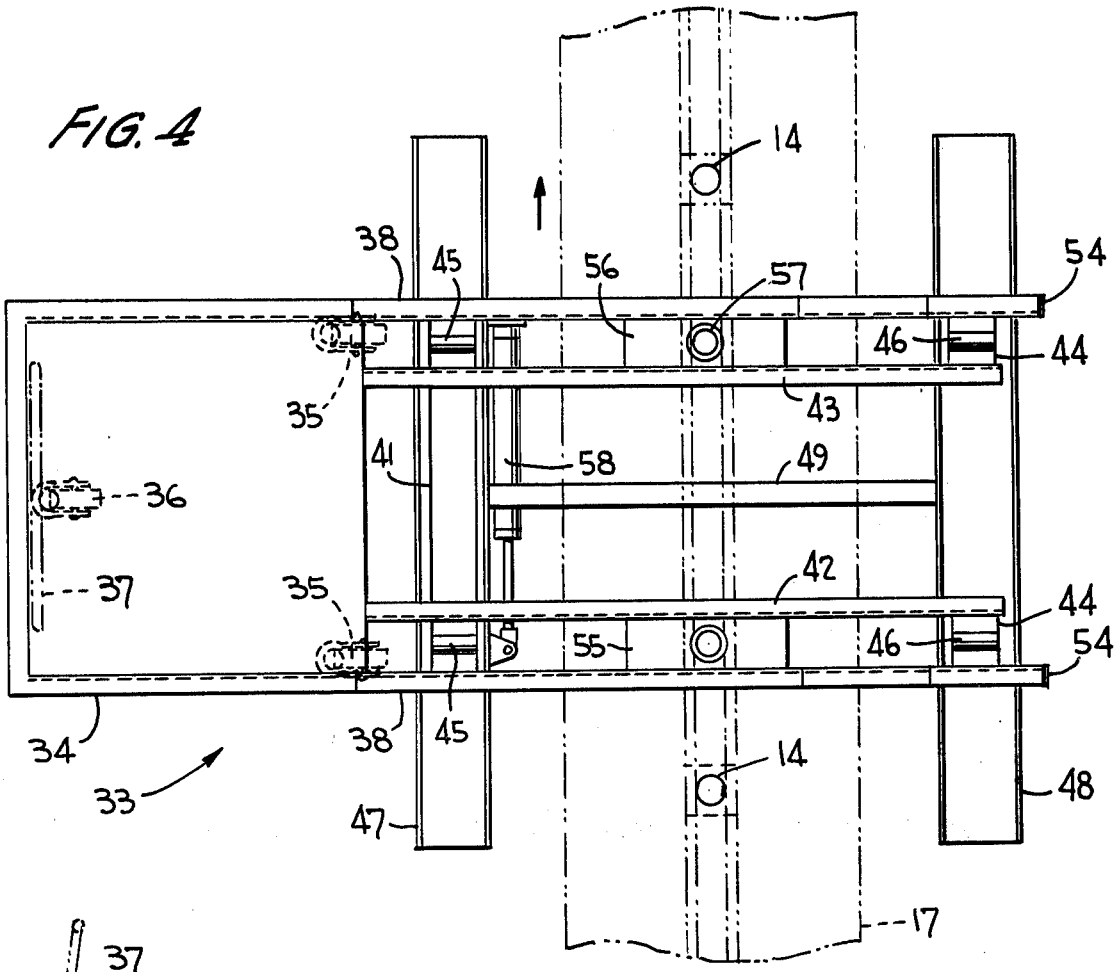
FIG. 4 is a top plan view of an apparatus used in side shifting each grandstand section during the setting up and taking down operations.
Figure 5:
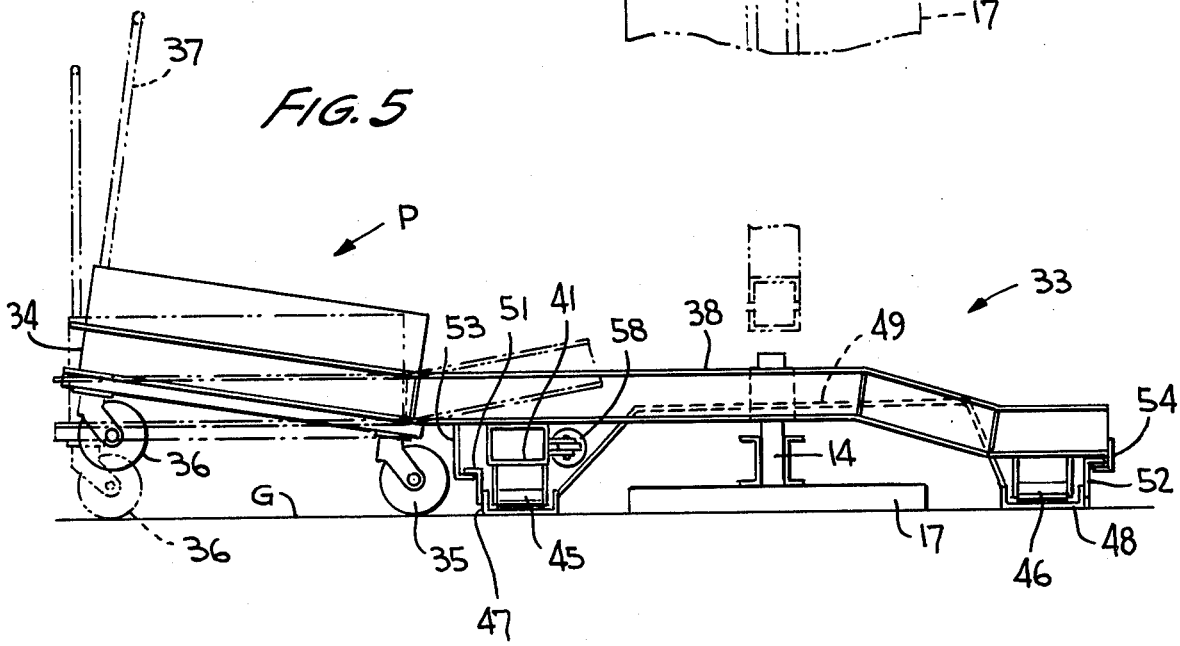
FIG. 5 is a side elevational view of the apparatus of FIG. 4.

Gap 32 must now be closed by side shifting section 10*c* into abutting engagement with the adjacent side end of section 10*x*. Such a side shifting may be carried out by means of a portable power unit, generally designated 33 in FIGS. 4 and 5, which is manually moved into place over central footing 17, as shown in phantom outline in FIG. 6. This power unit includes a platform 34 supported on the ground by a pair of forward caster wheels 35 and a rear caster wheel 36. FIG. 5 illustrates the power unit when placed in position over footing 17 with caster wheel 36 elevated from the ground, although it should be pointed out that this caster wheel is in a ground-engaging position as shown in phantom outline when the power unit is being manually maneuvered into position, the remaining portion of the power unit during such time being completely elevated off the ground, as partly shown in phantom outline. Power equipment generally designated P, such as a hydraulic tank, pump and power batterys are supported on platform 34, and a foldable or removable handle bar 37 is connected to the platform to facilitate manual movement of the power unit.

Beams 38 extend forwardly of the sides of the platform structure, and a cross-beam 41 spans beams 38 and is connected to the underside thereof. Inner beams 42 and 43 likewise extend forwardly from platform 34, are spaced inwardly of beams 38 and lie parallel thereto. Their outer ends are connected to adjacent beams 38 by means of plates 44, and rollers 45 and 46 are rotatably mounted to the underside of cross-beam 41 and to the underside of plates 44, respectively. Upwardly open transverse channels 47 and 48 are respectively disposed beneath rollers 45 and 46, and their inner side edges are interconnected by means of a connecting plate 49 or the like. Outwardly extending L-shaped flanges 51 and 42 are respectively provided on the outer side edges of channels 47 and 48, and downwardly extending L-shaped clips 53 and 54 on beams 38 loosely engage the undersides of flanges 51 and 52, respectively, so as to permit relative transverse movement between channels 47, 48 and the entire remaining portion of the power unit. Beam 42 and its adjacent beam 38 are interconnected between lower surfaces thereof by means of a plate 55, and beam 43 and its adjacent beam 38 are similarly interconnected by means of a plate 56. Hydraulic lift jacks 57 are supported on plates 55 and 56, and a two-way hydraulic piston and cylinder unit 58 is connected at one end to one of the beams 38 and at its other end to channel 47, as shown in FIG. 4. Jack 57 and unit 58 are, of course, operatively connected to power equipment P for the hydraulic operation thereof.

In operation, power unit 33 is moved into its position of FIGS. 4 to 6 whereby channels 47 and 48 straddle opposite sides of central footing 17. The grandstand section to be shifted is elevated until its footing 17 is raised slightly off ground G as jacks 57 are actuated to lift some portion of the grandstand understructure. Piston and cylinder unit 58 is then actuated for retracting its piston, if shifting movement is to be made in the direction of the arrow of FIG. 4, so that the entire power unit will be rolled on its rollers 45 and 46 longitudinally of channels 47 and 48 thereby causing the lifted grandstand section to be accordingly shited against an existing grandstand section, or otherwise into place if it constitutes the first section of the grandstand to be set up. Certainly, if gap 32 is not uniform, but is narrower at one end than the other, the power unit may be so positioned that its channels lie at the necessary angle to footing 17, so as to cause the grandstand to be angularly shifted.

It should be pointed out that, when the power unit is moved during the shifting operation, casters 35 remain only in light contact engagement with the ground so that they are easily turned in the direction of movement and do not resist turning even on soft ground.

In taking down the grandstand, an outer section, such as **10*a* of FIG. 1, is first shifted outwardly of its adjacent section 10*b* with the use of power unit 33 which operates as aforedescribed. Once shifted, the power unit is removed from beneath the grandstand section, fork lift truck T is brought in, its fork 29 is raised to elevate the rearward end of the section, wheels 18 are placed in a ground-engaging position as by extending the wheels or retracting footing 17, braces 23 are unlocked from legs 19 and latched at 25, and the rearward end is raised sufficiently to cause legs 19 to roll on rollers 26 as the rearward end of the grandstand section is lowered to the position of FIG. 3. The legs may then be latched at 25** and the section is towed to storage. The remaining grandstand sections are similarly taken down and returned to storage.

From the foregoing it can be seen that a simple and economical yet highly effective technique has been devised for the setting up and taking down of a grandstand formed of a plurality of portable grandstand sections. Constricted passageways into and from storage present no problem with the use of this technique since the rearward ends of the sections are lowered, and the sections with their legs 19 collapsed are substantially horizontal thereby permitting them to be more easily stored with the need for less space. The sections are easily manageable by the fork lift operators since they are carried in the manner of a trailer of a tractor-trailer vehicle. Side shifting is carried out without the need for auxiliary equipment provided on the grandstand sections themselves, and shifting is sufficiently precise so as to avoid the need for fillers between adjacent grandstand sections.

Figure 7:
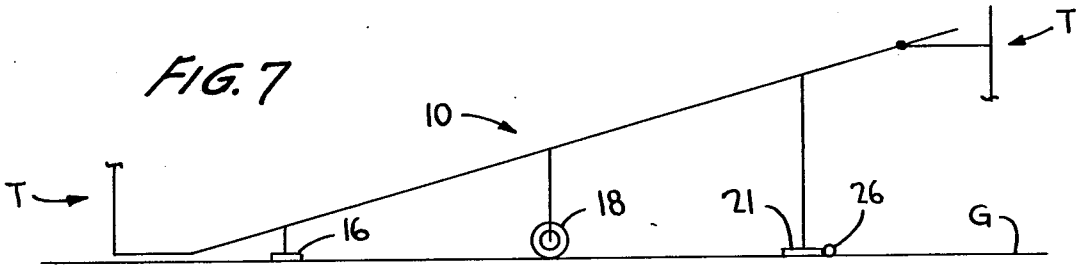
FIG. 7 is a schematic side view of an erect grandstand section, at a reduced scale, showing an alternative approach used in side shifting the sections.

Obviously, many modifications and variations are made possible in the light of the above teachings. For example, a pair of fork lift trucks T may be utilized as schematically shown in FIG. 7, in lieu of power unit 33, for the purpose of carrying out the side shifting operation. Thus, as opposite ends of the section are raised by the forks of the trucks, the standard side shift of the forklifts are used to shift the section into place.

Also, longer grandstand sections than that shown in the drawings may be provided with a pair of wheels 18 outwardly of supports 14 to accommodate the additional weight. Moreover, such a bearing section may be more readily lifted and towed by the forklift truck with its bearing 28 in engagement with a bearing cup 31 provid3d at the hinge 22 location. The same technique in setting up and taking down a plurality of such larger sections, as aforedescribed, would be applied.

Moreover, legs 19 could be made retractable by means other than collapsing them as described, as for example, providing telescoping legs 19, without departing from the scope of the invention.

Figure 8:
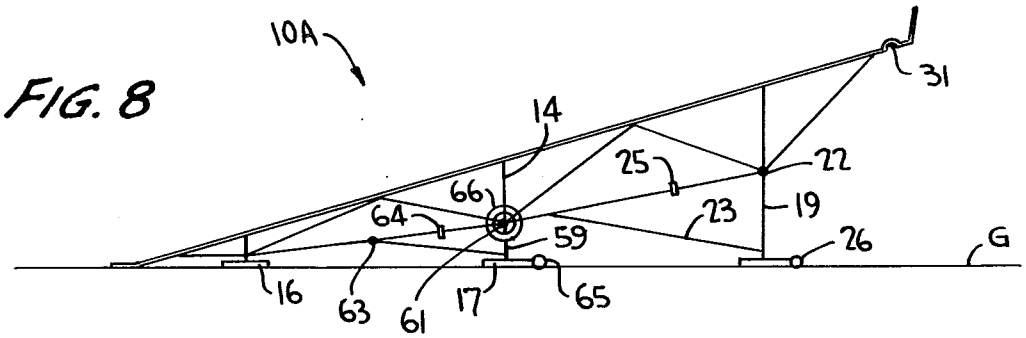
FIG. 8 is a schematic side view of an erect grandstand section, at a reduced scale, showing an alternative construction permitting a lesser overall collapsed height of the section.

Also, to reduce the overall height of each section, when collapsed at storage and while being towed, it may be constructed as shown at 10A in FIG. 8. Central footing 17 is mounted on vertical legs 59 which are hinged as at 61 to the understructure of the section for pivotal movement from an erect position as shown, to a collapsed position similarly as shown for footing 21 in FIG. 3. Braces 62 are hinged to the understructure as at 63 at one end and engage legs 59 at an opposite end thereof for bracing the legs when in their erect position of FIG. 8. Braces 63 may be latched as at 64 to the understructure of the section when legs 59 are collapsed. And, idler rollers 65 are mounted for rotation on the rearward end of footing 17 for the same purpose as rollers 26 described earlier.

Wheel means 66 are axle mounted for rotation on support 14 outwardly of footing 17 therefore, when section 10A is to be towed from its grandstand location back to storage, it is first shifted away from an adjacent section in the same manner as described above, and the forklift truck lifts the rearward end of the section sufficient to raise both footings 17 and 21 off the ground. Braces 23 and 62 are disengaged from their respective legs 19 and 59, the braces are latched respectively as at 25 and 64, and idler rollers 26 and 65 are brought into engagement with the ground. The rearward end of the section is then lowered so as to automatically collapse footings 21 and 17 as they pivot at 22 and 61 to be thereafter likewise latched at 25 and 64 to the understructure of the section. The lowering operation causes wheels 66 to be placed in a ground-engaging position for towing the section thereon. However, as compared to the aforedescribed embodiment, section 10A of the same size as section 10 will have a reduced overall height when being towed on its wheels 66 because of the FIG. 8 arrangement. The section may therefore be more easily moved through constricted passageways, and will take up less space in storage. The setting up of section 10A is carried out in the reverse order described for the set-up operation.

It is therefore to be understood that within the scope of the appended claims the invention may be practiced otherwise than as specifically described.

I claim:

1. A method of setting up and taking down a grandstand formed of a plurality of portable grandstand seating sections having a normal seating arrangement sloping upwardly and rearwardly from forward to rearward ends thereof, comprising the steps of: providing ground-engagable wheel means and a central footing on each of said seating sections between said forward and rearward ends, one of said wheel means and said central footing being made retractable and extendable for alternately assuming a ground-engaging position; placing said wheel means in said ground-engaging position; disposing each of said sections in a storage position by pivoting said each section at said wheel means so that said forward and rearward ends are at substantially the same elevation; transporting one of said sections from said storage position by moving it on said wheel means to a predetermined grandstand location; raising said rearward end of said one section at said grandstand location about an axis at said wheel means until said one section is in an erect position having said normal setting arrangement; moving said central footing into said ground-engaging position; shoring up said rearward end for supporting said one section in said erect position; lifting and shifting said one section in said erect position so as to move it into a predetermined grandstand position to commence formation of the grandstand.

2. The method according to claim 1, wherein said lifting and shifting steps are carried out by lifting said one section at said central footing and shifting it, while lifted, into said predetermined grandstand position, and lowering said lifted section at said grandstand position.

3. The method according to claim 1, wherein said shoring up step is carried out by providing collapsible and extendable leg means on said one section between said central footing and said rearward end so as to define a rear footing, moving said leg means to an extended position and maintaining it in said position.

4. The method according to claim 3, wherein said leg means is hinged at one end to said each section, and pivoting said leg to said extended position.

5. The method according to claim 1, further including repeating the recited steps for each of the remaining sections until the grandstand is completely formed, each said remaining sections being successively moved into said grandstand position until a side end thereof abuts against an adjoining side end of a section previously moved into said grandstand position.

6. The method according to claim 1, further including the steps of further lifting and shifting while lifting a first of said sections at said grandstand position away from an adjoining section of the grandstand, lowering said shifted first section for support on said central footing, moving said wheel means into said ground-engaging position, again pivoting said first section at said wheel means so that said forward and rearward ends are at substantially the same elevation, and transporting said shifted section by moving it on said wheel means into a storage location.

7. The method according to claim 6, wherein said shoring up step is carried out by providing collapsible and extendable leg means on said one section between said central footing and said rearward end so as to define a rear footing, moving said leg means to its extended position and maintaining it in said position.

8. The method according to claim 7, wherein said step of again pivoting said first section is preceded by collapsing said leg means and retaining it in a collapsed position.

9. The method according to claim 8, wherein said leg means comprises support legs hinged at one end to said each section, and bracing means being hinged at one end to said each section and engaging said legs for retaining them in said extended position, said collapsing step being further carried out by providing rollers on said rear footing, releasing engagement between said bracing means and said legs, lifting said rearward end to an elevation to raise said rear footing from a ground-engaging position, partially collapsing said legs and rolling said legs on said rollers into a fully collapsed position while lowering said rearward end into said same elevation.

10. The method according to claim 1, wherein said lifting and shifting steps are carried out by lifting said one section at said forward and rearward ends and shifting said one section, while lifted, into said predetermined grandstand position, and lowering said lifted section at said grandstand position.

11. The method according to claim 6, wherein said further lifting step is carried out by lifting said one section at said central footing.

12. The method according to claim 6, wherein said further lifting step is carried out by lifting said one section at said forward and rearward ends.

13. The method according to claim 1, wherein the step of moving said central footing into said ground-engaging position is carried out by providing said central footing as retractable into and extendable from said one section.

14. The method according to claim 1, wherein the step of moving said central footing into said ground-engaging position is effected by providing on said one section collapsible and extendable leg means on which said central footing is mounted, moving said leg means into an extended position and maintaining it in said position.

15. The method according to claim 14, wherein said leg means is hinged at one end to said each section, and pivoting said leg to said extended position.

16. The method according to claim 9, wherein the step of moving said wheel means into said ground-engaging position is effected by providing on said one section collapsible and extendable leg means on which said central footing is mounted, collapsing said leg means and retaining it in a collapsed position.

17. The method according to claim 16, wherein said leg means comprise further support legs hinged at one end to said each section, and bracing means being hinged at one end to said each section and engaging said further legs for retaining them in an extended position, said collapsing step being carried out by providing rollers on said central footing, releasing engagement between said bracing means and said further legs, lifting said rearward end to an elevation to raise said rear and central footings from a ground-engaging position, partially collapsing said legs and rolling said legs on said rollers into a fully collapsed position while lowering said rearward end into said same elevation.

18. A method of setting up and taking down a grandstand formed of a plurality of portable grandstand seating sections having a normal seating arrangement sloping upwardly and rearwardly from forward to rearward ends thereof, comprising the steps of: providing ground-engaging wheel means and central footing means on each of said sections between said forward and rearward ends; one of said wheel means and said central footing means being retractable into and extendable out of said each section for alternately supporting said each section on said central footing means and on said wheel means; providing rear footing means on said each section between said wheel means and said rearward end thereof; said rear footing means being collapsible so as to be retractable into and extendable out of said each section; transporting each said section between a grandstand location at which both said footing means are in a ground-engaging position and a storage location at which said rear footing means are retracted, said transporting step to said storage location including the sub-steps of lifting a first of said sections which forms an end section of the grandstand and shifting said first section away from a second of said sections which abuts against said first section, moving said wheel means into a ground-engaging position, retracting said rear footing means inwardly of said first section, lowering said rearward end of said first section relative to said wheel means, and rolling said first section on said wheel means while supporting said rearward end; and said transporting step being applied to said second section and to the remainder of said sections in succession.

19. The method according to claim 18, wherein said transporting step to said grandstand location includes the sub-steps of: rolling one of said sections on said wheel means while supporting said rearward end with said wheel means in a ground-engaging position, raising said rearward end at said grandstand location, moving said rear footing means for supporting said one section on both said footing means, and shifting said one section into a predetermined position for commencing formation of the grandstand; and repeating said transporting step to said grandstand location for the rest of said sections which are shifted in succession into abutting engagement with a side end of a previously transported section at said grandstand location.

20. The method according to claim 18, wherein said lifting step is carried out at said central footing means.

21. The method according to claim 19, wherein said lifting step is carried out at said central footing means.

22. The method according to claim 18, wherein said rear footing means is hinged to said each section and is provided with rollers thereon, said lowering of said rearward end effecting retraction of said rear footing means upon movement thereof along said rollers.

23. The method according to claim 19, wherein said rear footing means is hinged to said each section and is provided with rollers thereon, said raising of said rearward end at said grandstand location effecting extension of said rear footing means upon movement thereof along said rollers.

24. The method according to claim 18, wherein said lifting step is carried out at said forward and rearward ends.

25. The method according to claim 19, wherein said lifting step is carried out at said forward and rearward ends.

26. The method according to claim 18, wherein said transporting step to said grandstand location includes the step of moving said central footing means into said ground-engaging position by providing said central footing as retractable into and extendable from said one section.

27. The method according to claim 18, wherein said transporting step to said grandstand location includes the step of moving said central footing means into said ground-engaging position by providing on said one section collapsible and extendable leg means on which said central footing is mounted, moving said leg means into an extended position and maintaining it in said position.

28. The method according to claim 27, wherein said leg means is hinged at one end to said each section, and pivoting said leg to said extended position.

* * * * *